US006045962A

United States Patent [19]

Kushibiki et al.

[11] Patent Number: 6,045,962

[45] Date of Patent: Apr. 4, 2000

[54] METHOD FOR FORMING LOW SURFACE ENERGY COATING

[75] Inventors: Nobuo Kushibiki; Kikuko Takeuchi, both of Kanagawa, Japan

[73] Assignee: Dow Corning Asia, Ltd., Tokyo, Japan

[21] Appl. No.: 09/040,890

[22] Filed: Mar. 18, 1998

[30] Foreign Application Priority Data

Mar. 19, 1997 [JP] Japan ..... 9-066838
Aug. 29, 1997 [JP] Japan ..... 9-235182

[51] Int. Cl.[7] ..... G03G 5/147

[52] U.S. Cl. ..... 430/132; 430/66; 430/67; 427/387; 427/397.7

[58] Field of Search ..... 430/132, 66, 67; 427/387, 397.7; 428/212

[56] References Cited

U.S. PATENT DOCUMENTS 3,986,997 10/1976 Clark ..... 260/29.2 M
4,335,755 6/1982 Sadler et al. ..... 427/397.7
4,439,509 3/1984 Schank ..... 430/132
4,997,684 3/1991 Franz et al. ..... 427/397.7
5,731,117 3/1998 Ferrar et al. ..... 430/67

FOREIGN PATENT DOCUMENTS 5-46940 of 1993 Japan .

*Primary Examiner*—Christopher D. Rodee
*Attorney, Agent, or Firm*—Sharon K. Severance

[57] ABSTRACT

A method for forming a low surface energy coating for electrophotographic photosensitive body substrates does not require performing a physical surface reforming treatment such as corona discharge, plasma treatment, and the like. The process comprises: forming on the substrate at least one polysiloxane coating material, (B), that has a water contact angle greater than the water contact angle of the substrate; and thereafter forming an outermost surface coating material, (A), on top of coating material (B). The water contact angle of coating material (B) is smaller than the water contact angle of coating material (A). Coating material (A) comprises finely divided silica and a resin of the formula $RSiO_{3/2}$, wherein not less than 1 mol % and not more than 80 mol % of the R groups are fluorohydrocarbon groups of 3 to 12 carbon atoms.

14 Claims, No Drawings

METHOD FOR FORMING LOW SURFACE ENERGY COATING

FIELD OF THE INVENTION

This invention relates to a method for forming a fluorohydrocarbon-containing silicone coating material giving low surface energy on substrates without subjecting the substrates to preliminary physico-chemical treatment. The coating material may be used in electrophotographic applications.

BACKGROUND OF THE INVENTION

Organic materials that possess charge transfer ability by themselves can be used for making photosensitive bodies. Materials with charge transferability obtained by dispersing special organic compounds in organic high polymers can also be used for making photosensitive bodies. There is demand for high resolution, high-performance photosensitive bodies in various areas, and photosensitive bodies are subjected to various treatments. The use of silicone or fluorine-containing high polymers is known in the art to reduce the surface energy of photosensitive bodies and facilitate the removal of developers that remain after development from the surface of the photosensitive bodies.

Attempts to reduce the surface energy of photosensitive bodies by dispersing polydimethylsiloxane or silicone oils and other polysiloxane reins in the photosensitive material layer are known in the art. For example, JP-C-05-46940 (1993) discloses applying a surface-protecting layer of photosensitive material made up of a crosslinked polysiloxane. The crosslinked polysiloxane is composed of a product of joint hydrolytic condensation of trifunctional alkoxysilanes and tetrafunctional alkoxysilanes. However, the effects obtained by this method are not long-lasting because the method amounts to simply adding silicone oil.

When the surface of a photosensitive body is coated with a hard coating material made of polysilicone, its surface energy is not sufficiently low. It is known in the art that significant lowering of surface energy can be obtained with fluorine-based high polymers. However, their extremely poor solubility causes separation and light scattering when they are mixed with other high polymers.

Fluorohydrocarbon-containing polysiloxanes have been developed that have lower surface energy than conventional polysiloxanes. These polysiloxanes form transparent films and because they have low surface energy, they are suitable as materials capable of reducing the surface energy of photosensitive bodies. However, due to problems with wettability and adhesion, it is difficult to form coating films from them without subjecting ordinary polymeric materials to certain surface treatment.

The technology known in the art at present for the formation of coating films on substrates involves surface reforming using corona discharge, plasma treatment, and the like, to facilitate the formation of the coating film. However, subjecting functional materials that serve as a medium for the charge transfer phenomenon generated in response to electrochemical stimulation, such as photosensitive bodies, to this type of treatment is not a desirable method because their functionality is usually ruined. Therefore, one object of this invention is to provide a coating process that does not involve surface reforming of functional materials, such as photosensitive materials known in the art.

SUMMARY OF THE INVENTION

A method for forming a low surface energy coating on an electrophotographic photosensitive body substrate comprises:

1) forming on the substrate a coating of at least one coating material (B), and 2) forming on top thereof, a coating of coating material (A).

Coating material (B) has a water contact angle ($\theta_B$) greater than the water contact angle of the substrate ($\theta_S$), but less than the water contact angle ($\theta_A$) of coating material (A). Coating material (B) can be a polysiloxane resin. Coating material (A) comprises finely divided silica and a resin of the formula $R^1SiO_{3/2}$, wherein each $R^1$ is selected from the group consisting of fluorohydrocarbons, saturated hydrocarbons, and aromatic hydrocarbons.

DETAILED DESCRIPTION OF THE INVENTION

This invention relates to a method for forming low surface energy coatings on substrates. The method comprises:

1) forming on the substrate a coating of at least one coating material (B), and 2) forming on top of thereof, a coating of coating material (A).

Coating material (B) has a water contact angle ($\theta_B$) smaller than the water contact angle ($\theta_A$) of coating material (A), the outermost surface coating material. However, ($\theta_B$) is greater than the water contact angle of the substrate ($\theta_S$).

Coating material (A) comprises a resin and finely divided silica. Preferably, the resin has the general formula $R^1SiO_{3/2}$, where each $R^1$ is a group selected from the group consisting of fluorohydrocarbon groups of 3 to 12 carbon atoms; saturated hydrocarbon groups of 1 to 18 carbon atoms, with the proviso that the saturated hydrocarbon groups may also have oxygen atoms; and aromatic hydrocarbon groups of 6 to 18 carbon atoms; with the proviso that not less than 1 mol % and not more than 80 mol % of all the $R^1$ groups are fluorohydrocarbon groups.

When this method is used for coating substrates such as photosensitive bodies, it eliminates poor coating properties due to the significant differences in water contact angles by means of inserting at least one layer of coating material (B) between the substrate and coating material (A). Coating material (B) has a water contact angle adjusted so that it can be used for coating photosensitive body substrates. Coating material (B) can be, for example, a polysiloxane coating material.

Generally, higher amounts of fluorohydrocarbons, or greater chain lengths of the fluorohydrocarbons, in coating material (A) will cause greater differences in water contact angles between coating material (A) and photosensitive material substrates. The greater the difference in water contact angles, the more difficult it becomes to coat the surface of photosensitive bodies.

The outermost surface layer of electrophotographic photosensitive bodies is a charge transfer layer. Usually, the charge transfer layer is made up of a composite resin material composed of a charge transfer substance and a binder made up of a high molecular compound. Examples of suitable high molecular compounds include polyesters, polycarbonates, polystyrenes, polymethacrylic acid esters, polyacrylic acid esters, and the like. Suitable charge transfer substances include pinene, as well as anthracene and other polycyclic aromatic compounds, carbazole, indole, oxazole, thiazole, oxathiazole, pyrazole, pyrazoline, thiadiazole, as well as triazole and other heterocyclic compounds, p-diethylaminobenzaldehydo-N,N-diphenylhydrazone, N,N-diphenylhydrazino-3-methylidene-9-ethylcarbazole and other hydrazone compounds, a-phenyl-4'-N,N-diphenylaminostilbene, 5-(4-(di-p-tolylamino)benzylidene)-5H-dibenzo(a,d)cycloheptene and other stilbene compounds, benzidine compounds, triarylamine compounds, or high molecular compounds having groups made up of these compounds in the main chain or side chains, such as poly-N-vinyl carbazole, polyvinyl anthracene, and the like.

The ratio of the charge transfer compounds is not less than 20 wt % and not more than 70 wt % relative to the binder resin.

The water contact angles of the high molecular compounds are: 83~91° for polystilbenes, 71~81° for polyesters, and approximately 90° for polycarbonates. The water contact angle is 80° when the charge transfer substance is triphenylamine, and in many cases, the water contact angle of the surface of the electrophotographic photosensitive body becomes less than 90° for coating material (A). Good coating properties are not obtained if direct coating with fluorosilicone resins is carried out.

To obtain better coating, preferably coating material (B) is, for example, a siloxane coating material with $\theta_B<20°$ greater than $\theta_S$. Preferably, coating material (A), used on top of coating material (B), has $\theta_A<20°$ greater than $\theta_B$. Coating material (B) can be a siloxane coating material.

Coating material (A) is a coating material for the outermost layer with a larger water contact angle. Suitable resins for use in coating material (A) are siloxane resins in which perfluorocarbon groups of the general formula $C_nF_{2n+1}$ are bonded to silicon atoms through ethylene groups. Suitable perfluorocarbon groups include perfluoroethyl, perfluoropropyl, perfluorobutyl, perfluoroamyl, perfluorohexyl, perfluoroheptyl, perfluoroctyl, and the like. Fluorohydrocarbon-containing polysiloxane resins whose contact angle after coating on substrates is not less than 90° are preferred.

Coating material (B), which is applied between coating material (A) and the substrate, does not need to contain fluorohydrocarbon groups. For example, coating material (B) can be a polysiloxane resin that is a product of hydrolytic condensation of organic siloxane, in which the silicon-bonded groups are methyl groups. The contact angle of a polysiloxane, in which the silicon-bonded groups are only methyl groups, is 100° to 115°.

Coating material (A) preferably comprises finely divided silica and a resin as described above of the general formula $R^1SiO_{3/2}$. The resin contains not less than 1 mol % and not more than 80 mol % of fluorohydrocarbon groups of 3 to 12 carbon atoms. The water contact angle ($\theta_A$), depends on the type and amount of the fluorohydrocarbon groups used, and $\theta_A$ can be adjusted to be within the range of 90° to 117°.

The amount of finely divided silica is preferably 1 to 200 parts by weight, per 100 parts by weight of the resin. When the amount is less than 1 part by weight, the effects obtained are insufficient. If the amount is higher than 200 parts by weight, the product becomes brittle. Preferably, 10 to 100 parts by weight of finely divided silica is added. To form a uniform coating film, the primary particle diameter of the added finely divided silica is preferably not more than 100 nm; more preferably, not more than 50 nm. As long as it does not create problems in resin preparation, the finely divided silica may be subjected to surface treatment to achieve uniform dispersion of the finely divided silica in solvents, while suppressing the formation of secondary particles. Examples of suitable finely divided silicas for this invention include silica gels and colloidal silicas.

When a photoconductive layer is selected as the substrate, additives can be used therein to increase durability and improve mechanical characteristics. Suitable additives include anti-oxidants, ultraviolet radiation-absorbing agents, stabilizers, crosslinking agents, lubricants, conductivity-controlling agents, and the like. The low surface energy coating is formed on top of the photoconductive layer. Solvents that do not adversely affect the photoconductive layer are preferable as the solvents employed in the composition used to form the low surface energy coating. The composition is applied by dip coating, roller coating, and like techniques.

When applying the low surface energy coating to the photoconductive layer, the coating solution is usually adjusted by using solvents that are inert to the high polymers serving as binders and charge transfer substances. Alcohol-based solvents are preferable. Lower alcohols are more preferable because of their drying properties after coating. Examples of the preferred lower alcohols include methanol, ethanol, isopropanol, butanol, and the like. These solvents do not cause swelling or dissolution of the high polymers serving as binders and charge transfer substances.

Preparation of the resin (coating material (A)) is carried out by hydrolytic condensation of a silane of formula $R^2Si(OR^3)_3$, where each $R^2$ is selected from the group consisting of fluorohydrocarbon groups of 3 to 12 carbon atoms; saturated hydrocarbon groups of 1 to 18 carbon atoms, with the proviso that the saturated hydrocarbon groups may have oxygen atoms; and aromatic hydrocarbon groups of 6 to 18 carbon atoms. However, not less than 1 mol % and not more than 80 mol % of all the $R^1$ groups are fluorohydrocarbon groups of 3 to 12 carbon atoms. Each $R^3$ is a saturated hydrocarbon group of 1 to 8 carbon atoms. Finely divided silica dispersed in a lower alcohol is mixed with a solvent containing a sufficient amount of water for hydrolysis of the silane. The solvent used for synthesis is preferably selected from lower alcohols. The silane is added to the mixture, and hydrolytic condensation is carried out.

The condensation can be accelerated by adding a catalyst. Because the resin is intended for use in electrophotographic photosensitive bodies, it is preferable to avoid using primary and secondary amines, which affect charge transfer. Suitable catalysts include organic acids such as formic acid, acetic acid, propionic acid, oxalic acid, malonic acid, glutaric acid, glycolic acid, and tartaric acid; and esters of the organic acids.

When the reaction is carried out in this manner, the silanol groups remaining in the finely divided silica and the hydrolyzed silane react with each other, forming silica that is chemically fixed in polysiloxane. When the product is used for coating, the strength of the coating film tends to improve. Hydroxyl groups and hydrolyzable groups are examples of the groups bonded to silicon that remain in the polysiloxane. Residual hydroxyl groups and hydrolyzable groups are commonly used as crosslinkable functional groups. If there is an excessive amount of residual hydroxyl groups and hydrolyzable groups, storage stability of the polysiloxane tends to decrease. However, if the amount is too small, sufficient crosslinking does not take place.

Preferably, the amount of hydroxyl and hydrolyzable groups bonded to silicon atoms in the polysiloxane is 0.1 to 4 wt %. The amount of these groups can be adjusted to the desired range using methods known in the art. For example, alkoxysilanes and such can be added during or after the synthesis of the polysiloxane. When crosslinking polysiloxane with an adjusted amount of hydrolyzable groups, crosslinking can be carried out by adding crosslinking agents. Suitable crosslinking agents include silicon compounds with siloxane bonds having multiple hydrolyzable groups or hydroxyl groups in each molecule. Suitable hydrolyzable groups include methoxy, ethoxy, propoxy, acetoxy, butoxy, and methylethylketoxime.

When the substrate is an electrophotographic photosensitive body, catalysts can be added to the coating material during curing, as long as they do not hamper charge transfer therein. Suitable catalysts for curing include dimethylamine acetate, ethanolamine acetate, dimethylaniline formate, tetraethylammonium benzoate, sodium acetate, sodium propionate, sodium formate, benzyltrimethylammonium acetate, dibutyltin dilaurate, and the like.

Leveling agents may be used as additives, as long as this is not detrimental to the effects of the present invention. Suitable leveling agents include polyester-modified silicones, and the like.

This invention provides a coating process that achieves improvements in optical characteristics required of electrophotographic photosensitive bodies and in cleaning resistance. The process prevents decreases in surface tension in the process of repeated cleaning. The process also provides improvements in wear characteristics during toner cleaning, and the like. The process can be applied to ordinary organic substrates, as well as electrophotographic photosensitive materials.

EXAMPLES

These examples are intended to illustrate the invention to those skilled in the art and should not be interpreted as limiting the scope of the invention set forth in the claims.

Water contact angles were measured using contact angle measuring equipment (model CA-D, from Kyowa Kaimen Kagaku (K. K.)).

"Isopropyl alcohol dispersion T of colloidal silica" is defined in Table 1. Particle Diameters are expressed in nm.

TABLE 1

Definitions

| | Manufacturer | Product Name | Particle Diameter | Content of $SiO_2$ (wt %) |
|---|---|---|---|---|
| Isopropyl alcohol dispersion T of colloidal silica | Nissan Chemical Industries, Ltd. | IPA-ST | 10~20 | 30 |

Example 1

80 parts of 4-ethyltriphenylamine per 100 parts of polycarbonate was dissolved in 200 ml of tetrahydrofuran. The solution was applied to an aluminum substrate and dried at a temperature of 120° C. for 1 hour. Water contact angle was 90.2°.

20.5 g of isopropyl alcohol dispersion T of colloidal silica, 25.6 g of methyltriethoxysilane, 5.9 g of 3,3,4,4,5,5,6,6,6-nonafluorohexyltrimethoxysilane, and 3.2 g of acetic acid were combined. The mixture was heated to 65~70° C., and the reaction was carried out for 2 hours. The product was diluted with 21.7 g of isopropyl alcohol, thereby preparing a coating solution. The solution was applied to the substrate using a bar coating technique and dried for 1 hour at a temperature of 120° C. to form a coating film, B1. Water contact angle was 98.6°. The coating film was uniform and exhibited no clouding.

5.99 ml of water, 32.13 g of methyltriethoxysilane, 2.83 g of n-perfluoroctylethyltriethoxysilane, and 6.29 g of acetic was added to 32.07 g of isopropyl alcohol dispersion T of colloidal silica. The mixture was heated to 65~70° C., and the reaction was carried out for 2 hours. The product was diluted with 1.58 g of isopropyl alcohol, and 2.4 g of dibutyltin dilaurate was gradually added thereto, thereby preparing a coating solution. The solution was applied to coating film B1 using a bar coating technique and dried for 1 hour at a temperature of 120° C. to form coating film A. The coating film was uniform and exhibited no clouding. Water contact angle was 110°.

Comparative Example 1

5.99 ml of water, 32.13 g of methyltriethoxysilane, 2.83 g of n-perfluoroctylethyltriethoxysilane, and 6.29 g of acetic were added to 32.07 g of an isopropyl alcohol dispersion of colloidal silica (solid matter: 30 wt %). The mixture was heated to 65~70° C., and the reaction was carried out for 2 hours. The product was diluted with 1.58 g of isopropyl alcohol, and 2.4 g of dibutyltin dilaurate was gradually added thereto, thereby preparing a coating solution.

The coating solution was directly applied to a substrate obtained by dissolving 80 parts 4-ethyltriphenylamine per 100 parts of polycarbonate in 200 ml of tetrahydrofuran, applying the solution to an aluminum substrate and drying it at a temperature of 120° C. for 1 hour. The solution was then dried at a temperature of 120° C. for 1 hour. The resultant film exhibited clouding, and uniform film formation was not observed.

We claim:

1. A method for forming a low surface energy coating comprising:

i) forming a coating of at least 1 coating material (B) having a water contact angle $\theta_B$ on a substrate having a water contact angle $\theta_S$ and thereafter ii) forming a coating of coating material (A) having a water contact angle $\theta_A$ on top of coating material (B);

wherein $\theta_S$ is less than $\theta_B$, $\theta_A$ is greater than $\theta_B$; and wherein coating material (A) comprises finely divided silica and a resin of general formula $R^1SiO_{3/2}$, wherein each $R^1$ is selected from the group consisting of fluorohydrocarbon groups of 3 to 12 carbon atoms; saturated hydrocarbon groups of 1 to 18 carbon atoms, with the proviso that the saturated hydrocarbon groups may further comprise oxygen atoms; and aromatic hydrocarbon groups of 6 to 18 carbon atoms; and with the proviso that not less than 1 mol % and not more than 80 mol % of all the $R^1$ groups are fluorohydrocarbon groups.

2. The method of claim 1, wherein the difference between $\theta_A$ and $\theta_B$ is less than or equal to 20°.

3. The method of claim 1, wherein the difference between $\theta_B$ and $\theta_S$ is less than or equal to 20°.

4. The method of claim 1, wherein the substrate is a charge transfer layer of an electrophotographic photosensitive body.

5. The method of claim 4, wherein the charge transfer layer comprises:

a) a charge transfer substance selected from the group consisting of polycyclic aromatic compounds, heterocyclic compounds, hydrazone compounds, stilbene compounds, benzidine compounds, triarylamine compounds, and compounds having groups made up of polycyclic aromatic compounds, heterocyclic compounds, hydrazone compounds, stilbene compounds, benzidine compounds, and triarylamine compounds in the main chain, side chains, or both; and b) a binder selected from the group consisting of polyesters, polycarbonates, polystyrenes, polymethacrylic acid esters, and polyacrylic acid esters.

6. The method of claim 5, wherein the charge transfer layer further comprises an additive selected from the group consisting of anti-oxidants, ultraviolet radiation-absorbing agents, stabilizers, crosslinking agents, lubricants, and conductivity-controlling agents.

7. The method of claim 1, wherein the fluorohydrocarbon groups for $R^1$ are perfluorocarbon groups bonded to silicon atoms through ethylene groups.

8. The method of claim 7, wherein the perfluorocarbon groups are selected from the group consisting of perfluoroethyl, perfluoropropyl, perfluorobutyl, perfluoroamyl, perfluorohexyl, perfluoroheptyl, and perfluoroctyl.

9. The method of claim 1, wherein the finely divided silica in coating material (A) is present in an amount of 1 to 200 parts by weight, per 100 parts by weight of the resin.

10. The method of claim 9, wherein the amount of finely divided silica is 10 to 100 parts by weight, per 100 parts by weight of the resin.

11. The method of claim 1, wherein the finely divided silica has a primary particle diameter of not more than 100 nm.

12. The method of claim 11, wherein the diameter is not more than 50 nm.

13. The method of claim 1, wherein coating material (B) is a polysiloxane coating material.

14. The method of claim 13, wherein the polysiloxane coating material is a polysiloxane resin.

* * * * *